US006260615B1

(12) United States Patent
Dalrymple et al.

(10) Patent No.: US 6,260,615 B1
(45) Date of Patent: Jul. 17, 2001

(54) METHOD AND APPARATUS FOR DE-ICING OILWELLS

(75) Inventors: Larry Verl Dalrymple; Harold Dean Eastin; Thomson Hall Wallace, all of Claremore, OK (US)

(73) Assignee: Baker Hughes Incorporated

( * ) Notice: Subject to any disclaimer, the term of this patent is extended or adjusted under 35 U.S.C. 154(b) by 0 days.

(21) Appl. No.: 09/344,790

(22) Filed: Jun. 25, 1999

(51) Int. Cl.[7] ..... E21B 36/04; E21B 43/24

(52) U.S. Cl. ..... 166/60; 166/66; 166/302; 166/901; 392/301

(58) Field of Search ..... 166/60, 65.1, 66, 166/302, 901; 392/301, 468, 472

(56) References Cited

U.S. PATENT DOCUMENTS

| | | | | |
|---|---|---|---|---|
| 2,260,916 | | 10/1941 | Rial | 219/33 |
| 2,738,409 | | 3/1956 | Bowman . | |
| 2,754,912 | | 7/1956 | Curson | 166/60 |
| 3,456,096 | * | 7/1969 | Bilbro | 219/501 |
| 3,493,050 | | 2/1970 | Kelley et al. | 166/267 |
| 3,859,503 | | 1/1975 | Palone | 219/278 |
| 4,486,149 | | 12/1984 | Merkel | 417/32 |
| 4,509,599 | | 4/1985 | Chenoweth et al. | 166/370 |
| 4,704,514 | | 11/1987 | Van Egmond et al. . | |
| 4,790,375 | | 12/1988 | Bridges et al. | 166/60 |
| 5,782,301 | | 7/1998 | Neuroth et al. | 166/302 |
| 5,974,226 | * | 10/1999 | Shaffer | 392/301 |
| 6,006,837 | | 12/1999 | Breit | 166/302 |
| 6,009,940 | * | 1/2000 | Eck et al. | 166/60 |

* cited by examiner

*Primary Examiner*—William Neuder
*Assistant Examiner*—Jennifer Dougherty
(74) *Attorney, Agent, or Firm*—Bracewell & Patterson, LL; James E. Bradley

(57) ABSTRACT

A power cable for an ESP is used also for heating well bores in cold climates. An electrical switch is located within a wellbore at a selected location in the power cable. The electrical switch is provided to selectively short out the conductors within the power cable, thereby allowing the power cable above the switch to be used as a resistive heating element to thaw the wellbore. While the switch is open, power supplied to power cable drives ESP in a normal manner.

17 Claims, 5 Drawing Sheets

METHOD AND APPARATUS FOR DE-ICING OILWELLS

TECHNICAL FIELD

The invention relates in general to electrical cable and in particular to a method and apparatus for transferring heat to a wellbore.

BACKGROUND ART

The production of oil and gas reserves has taken the industry to increasingly remote inland and offshore locations where hydrocarbon production in extremely cold climates is often required. When oilwells are completed in extremely cold environments, problems occur when a submersible pump is first installed and thereafter any time production is stopped. As a result, production techniques in remote and extreme climates require creative solutions to problems not usually encountered in traditionally warmer areas.

One problem often encountered in cold climate hydrocarbon production has been finding ways to maintain adequate hydrocarbon flow characteristics in production tubing. For example, under arctic conditions, a deep permafrost layer surrounds the upper section of a wellbore. The cold permafrost layer cools the hydrocarbon production fluid as it moves up the production tubing, causing hydrates to crystallize out of solution and attach themselves to the inside of the tubing. Paraffin and asphaltene can also deposit on the inside of the tubing in like manner. As a result, the effective cross-section of the tubing is reduced in many portions of the upper section of the wellbore, thereby restricting and/or choking off production flow from the well. Also, if water is present in the production stream and production is stopped for any reason such as a power failure, the water can freeze in place and block off the production tubing.

Wellbores having electrical submersible pumps experience higher production pressures due to the above restrictions. The higher production pressures accelerate wear of the pump and reduce the run life of the system, causing production costs to increase. Wells without downhole production equipment also suffer from similar difficulties as production rates fall due to deposition buildup. One method of overcoming these problems is to place a heating device of some sort adjacent to the production tubing to mitigate fluid temperature loss through the cold section of the well.

Presently, conventional heating of the production tubing utilizes a specialized electrical heat trace cable incorporating a conductive polymer which is attached to the tubing. This polymer heat trace cable is designed to be temperature sensitive with respect to resistance. The temperature sensitive polymer encapsulates two electrical conductors. As the electrical current flows through the polymer between the conductors it causes resistance heating within the polymer, which in turn raises the temperature of the polymer. As the temperature increases, the resistance of the polymer increases and the system becomes self regulating. However, this conventional approach to making a power cable for application in oil wells has several severe limitations.

One primary disadvantage of heat trace cable with conductive polymers is that these polymers can easily be degraded in the hostile environment of an oil well. To overcome this, several layers of expensive high temperature protective layers have to be extruded over the heat trace cable core. This increases the cost substantially and makes the cables very difficult to splice and repair. Another disadvantage of heat trace cables of conventional conductive polymer design is that the length of the cables is limited due to the decrease in voltage on the conductors along the length. This requires extra conductors to be run along the heat trace cable to power additional sections of heat trace cable deeper in the well. These extra conductors also require extra protection with appropriate coverings, and they require extra splices along the cable assembly. Splices also reduce reliability of the system and the coverings add further increase to the cost.

Conventional electrical submersible pumps use a three-phase power cable that has electrical insulated conductors embedded within an elastomeric jacket and wrapped in an outer armor. The insulation is fairly thick, being typically in the range from 0.070 to 0.090 inches in thickness. One type, for hydrogen sulfide protection, employs extruded lead sheaths around the insulated conductors. An elastomeric braid, tape or jacket separates the lead sheaths from the outer armor. Other types of cable use non-metal sheaths.

One solution is set forth in U.S. Pat. No. 5,782,301 to Neuroth, et al. for an "Oil Well Heater Cable". The 5,782,301 patent teaches a heater cable to be strapped alongside tubing in a well to heat production fluids flowing through the tubing. The heater cable has three copper conductors surrounded by a thin electrical insulation layer. An extrusion of lead forms a protective layer over the insulation layers. The lead sheaths have flat sides which abut each other to increase heat transfer. A metal armor is wrapped around the lead sheaths of the three conductors in metal-to-metal contact. Three phase power is supplied to the conductors, causing heat to be generated which transmits through the lead sheaths and armor to the tubing.

SUMMARY OF THE INVENTION

A device and method for heating production tubing in a reliable manner that utilizes existing power cables without requiring expensive multi-layer protective coverings and extra splices is provided.

The apparatus and method of the invention applies heat to de-ice oil wells in subsurface oil well applications. A multi-conductor electrical cable having an electrical switch at a selected location thereon is disclosed.

The electrical switch may be placed anywhere along the length of the power cable. Preferably, the switch is positioned just below the bottom of the permafrost zone, typically about 2,000 feet in arctic conditions. The switch may be mercury, solid state or other suitable type. In the "open" condition, the switch allows normal operation of an electrical submersible pump (ESP). The switch may be used with any type of electrically operated submersible pump. To thaw the well, the switch is activated by an electrical signal from the surface in a manner known in the art. The heater cable may be controlled by a motor variable control and heater cable transformer control that is two phase or three phase with a selectable or constant voltage level to the cable. The electrical signal causes the switch to close, which temporarily introduces a short across the three phases of the power cable. Such a condition prevents activation of the ESP motor but allows the cable above the switch to be used as a resistive heating element to thaw the well. The temperature sensing device may be a standard thermocouple. The temperature sensing device is preferably installed just above the switch. However, the cable above the switch remains roughly uniform in temperature, therefore other locations are acceptable. Permanent thermocouples, wireline deployed sensors or loop resistance measurements may be used to monitor temperatures to be sure the rated operating temperature of the power cable is not exceeded. Cables are readily available with temperature ratings in excess of 400 degrees.

Once trials are run and empirical data is collected, a simple transformer is selected to provide a voltage level that dissipates enough heat to thaw the well but not damage the cable. Preferably, a separate transformer is used to supply power to the heater cable. The transformer steps down the voltage to an appropriate level, while the motor typically runs on a higher voltage. Preferably, approximately 50 to 300 amps are used to generate sufficient heat. Once the well is thawed, another electrical signal from the surface causes the switch to return to its "open" condition and normal operation of the ESP unit resumes. The conductors are preferably made of copper or of other low resistance conducting the metal. A protective sheathing encapsulates the dielectric material. The protective sheathing is typically made of lead, although other material may be used. The cable may be made in a flat or round configuration and is completed by armoring the conductor assembly with an overall wrap of steel tape, providing extra physical protection.

The power cable may also optionally include thermocouples and/or other sensors to monitor temperature of the power cable and/or other characteristics of the surrounding environment. For example, temperature at various points along the length of the cable may be monitored and relayed to a microprocessor so as to adjust the power source to the heater cable. Other instruments also may be connected to the far end of the power cable to use the power cable as a transmission means to carry additional well performance data to a microprocessor.

In the preferred embodiment, a three-phase copper conductor power cable is disclosed. However, the invention may be used with a two-conductor system. The cable delivers heat along the tubing in the wellbore, thereby melting or remediating any build-up of hydrates, ice, asphaltenes and paraffin wax or other heat sensitive substances that may collect on the inner surface of the production tubing, causing a restriction or obstruction to production fluid flow.

DISCLOSURE OF THE INVENTION

Figure 1:
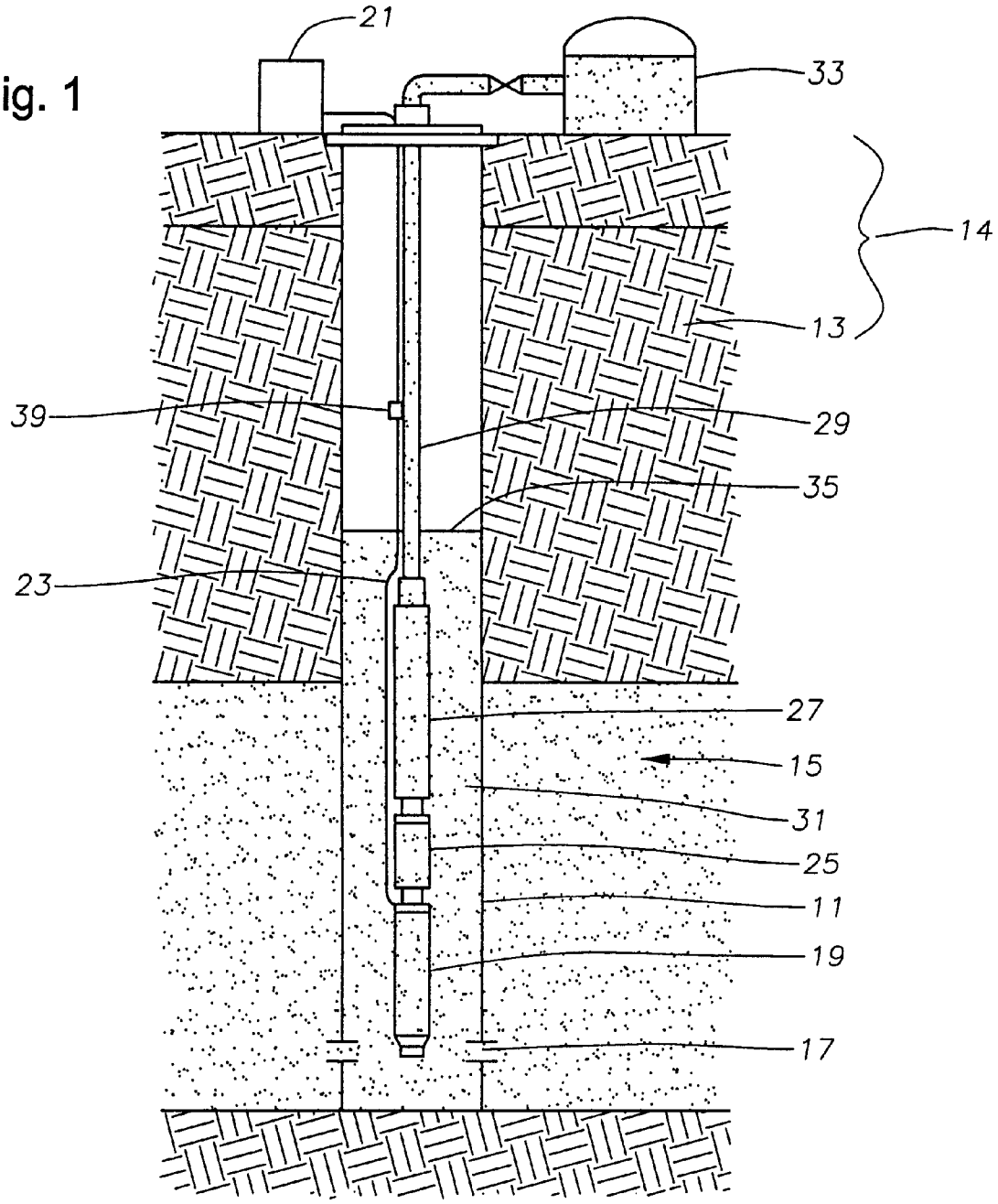
FIG. 1 is a schematic sectional view illustrating a well having a power cable in accordance with this invention.

Referring now to FIG. 1, well casing 11, consisting of one or more strings of casing, is located within a well in earth formation 13. Well casing 11 passes through the permafrost zone 14 and also passes through a producing zone 15. Perforations 17 formed in the well casing 11 enable the fluid in the producing zone to enter the casing 11.

Figure 2A:
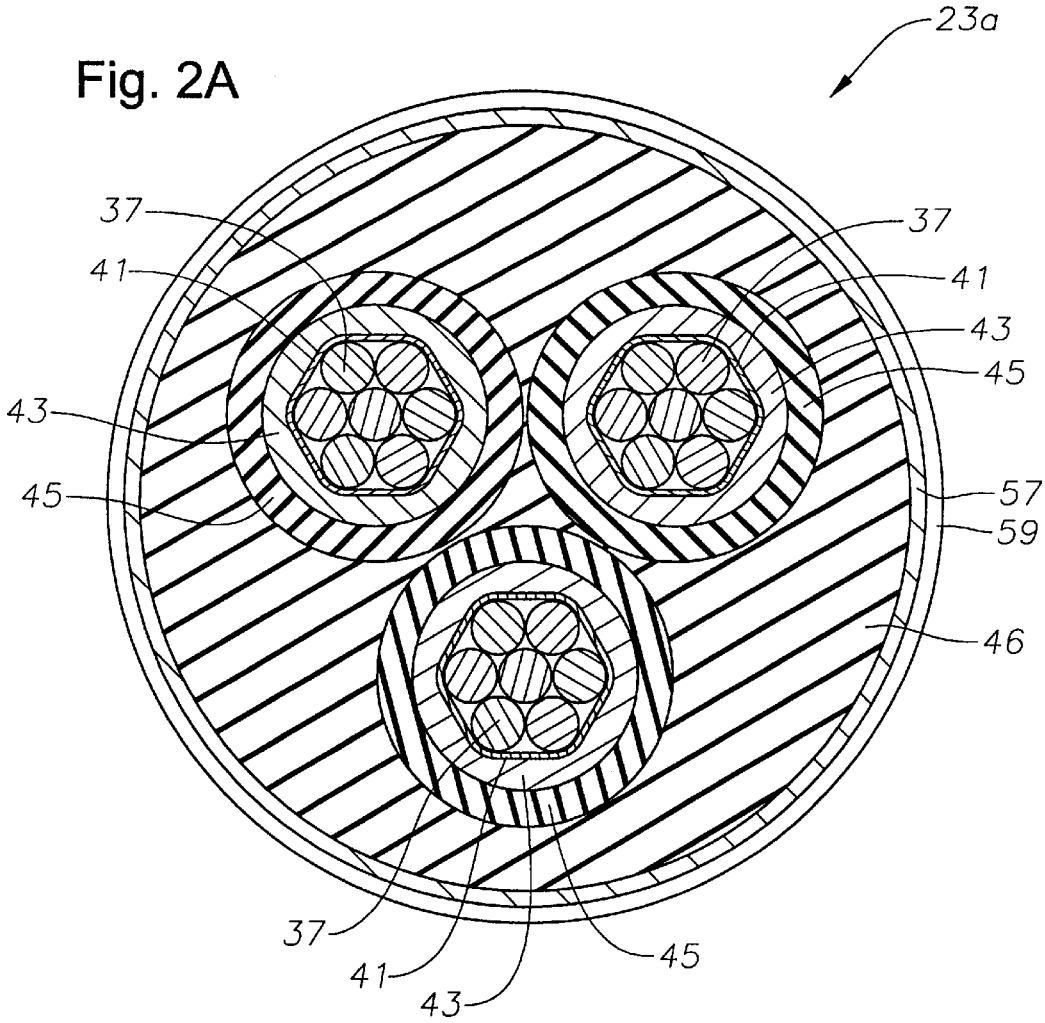
FIG. 2*a* is an enlarged cross-sectional view of the power cable of FIG. 1, wherein the power cable is a typical round cable.
Figure 2B:
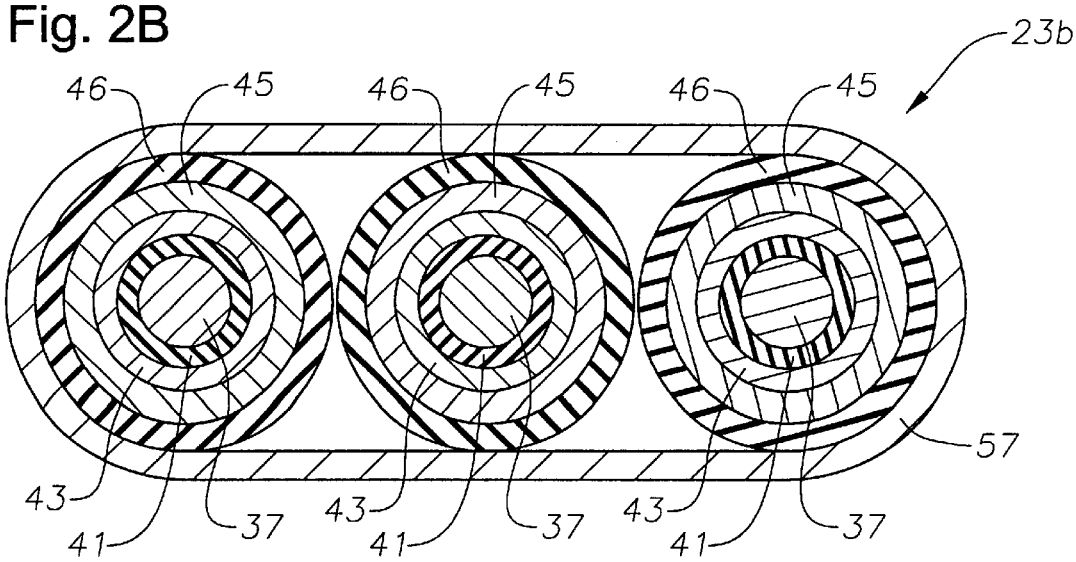
FIG. 2*b* is an enlarged cross-sectional view of the power cable of FIG. 1, wherein the power cable is a typical flat cable.

Referring to FIGS. 1, 2*a* and 2*b*, the submersible pump assembly includes an electrical motor 19 that is located in the well. Electrical motor 19 receives power from a power source 21 via power cable 23. Power cable 23 extends down the well along tubing 29. The shaft of motor 19 extends through a seal section 25 and is connected to a centrifugal pump 27. Pump 27 is connected to tubing 29 for conveying well fluid 31 to a storage tank 33 at the surface. The casing 11 will contain an operating fluid level 35 in the annulus of the casing 11. The pump 27 must be capable of delivering fluid for the distance from level 35 to the surface tank 33.

Figure 3:
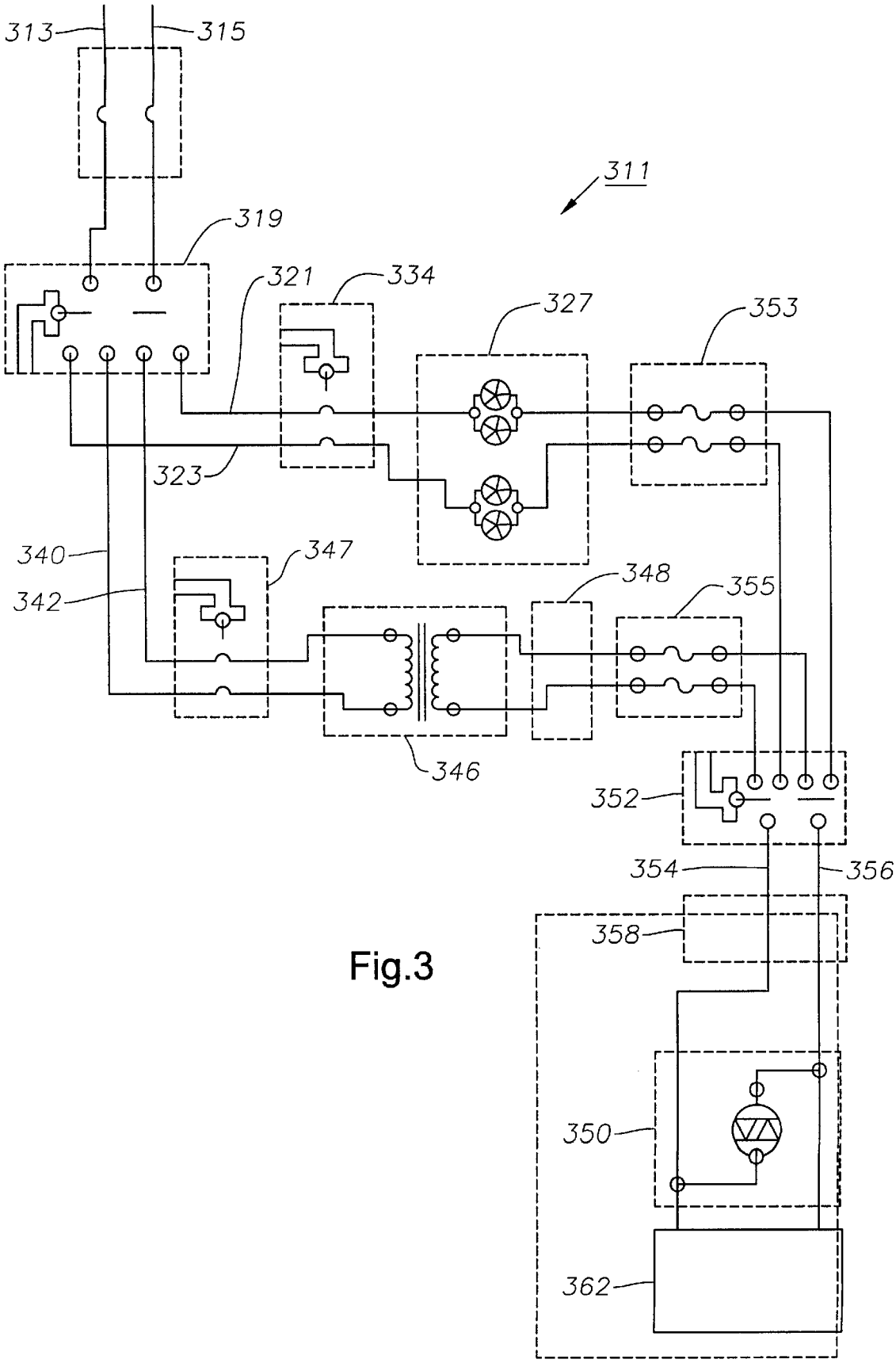
FIG. 3 is a schematic view of a motor variable control and two phase heater cable transformer control.
Figure 4:
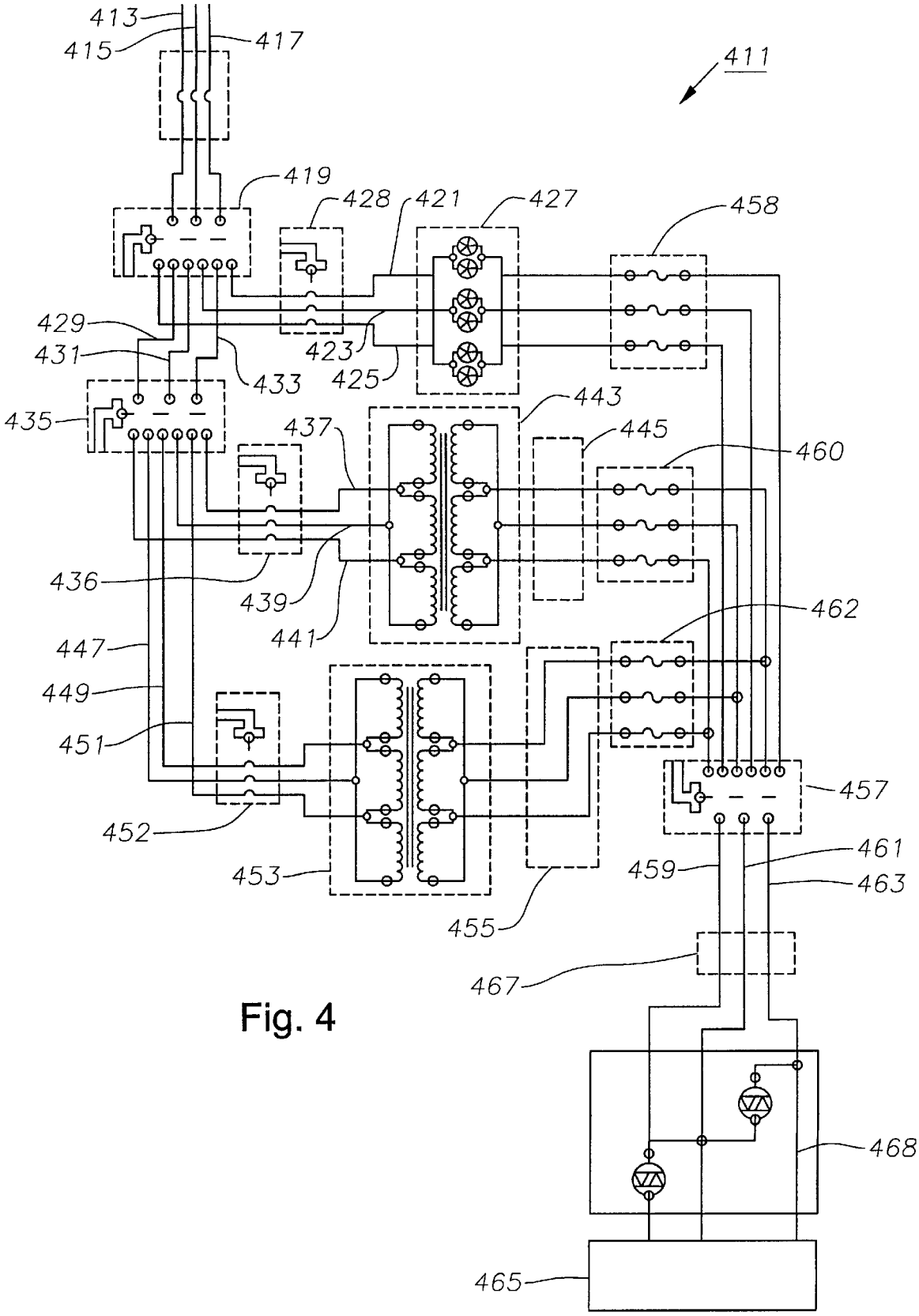
FIG. 4 is a schematic view of a motor variable control and three phase heater cable control with voltage control.
Figure 5:
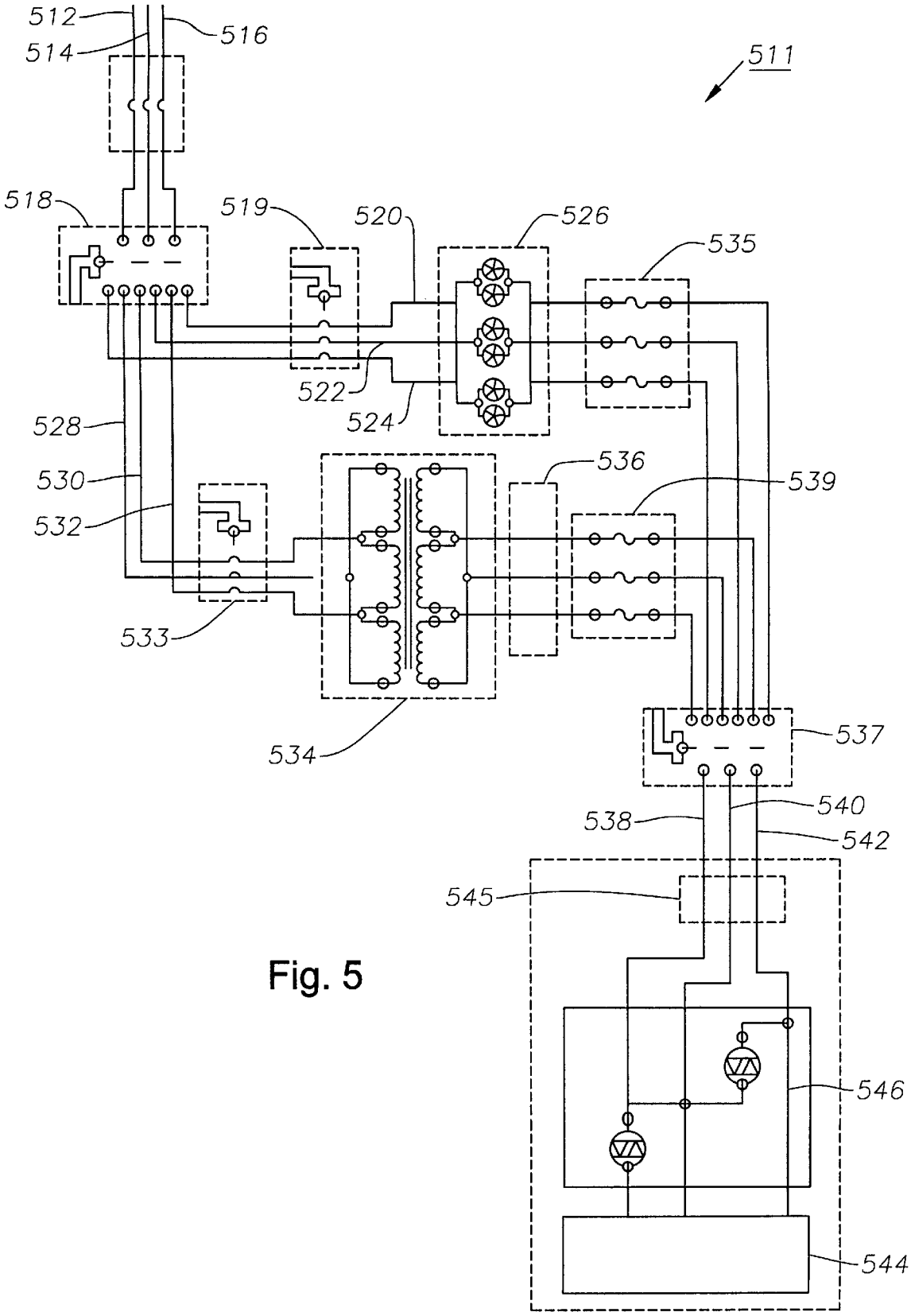
FIG. 5 is a schematic view of a motor variable control and three phase heater cable control without voltage control.

Straps secure power cable 23 to tubing 29 at regular intervals. An enlarged cross-section of power cable 23 is shown in a round type 23*a* in FIG. 2*a* and a flat type 23*b* in FIG. 2*b*. Similar components in FIGS. 2*a* and 2*b* will have the same numbers. Power cable 23*a*, 23*b* have three conductors 37 (FIGS. 2*a*, 2*b*), which are of a good electrical conductive material, such as metal. In one embodiment, conductors 37 are #6 AWG copper. The three conductors 37 are electrically insulated from each other and are connected at the surface to power source 21 that supplies three-phase electrical current down conductors 37 to an electrical motor 19 of an electrical submersible pump (ESP). A switch 39 (FIG. 1), such as a thyristor, which is schematically represented in FIGS. 3–5, is installed within the cable 23. The switch 39 is activated by an electrical signal from the surface. Switch 39 is preferably positioned below the bottom of permafrost zone 14 in a well, typically about 2,000 feet in arctic conditions. The switch 39 may be mercury, solid state or other suitable type. In the "open" condition, the switch 39 allows normal operation of an electrical submersible pump. Switch 39 may be used with any type of electrically operated submersible pump. To thaw the well, the switch 39 is activated by an electrical signal from the surface in a manner known in the art. One method of transmitting data over power cable 23 utilizes a magnetically saturable core reactor and is described in U.S. Pat. No. 5,670,931 to Besser et al. The electrical signal causes the switch 39 to close, which temporarily introduces a short across the three phases of the power cable 23. Such a condition prevents activation of the ESP motor but allows the cable 23 above the switch 39 to be used as a resistive heating element to thaw the well. Referring to FIGS. 2*a* and 2*b*, an enlarged cross-section of cable 23 is shown. FIG. 2*a* shows a typical round ESP cable 23*a* and FIG. 2*b* shows a typical flat ESP cable 23*b*. Each conductor 37 is surrounded by a dielectric layer, which is a good high temperature electrical insulation. The dielectric layer may include a polymer film or tape 41, which is preferably a polyamide marketed under the trademark Kapton.

Alternately, the tape may be from a group consisting of chlorotrifluoroethylene, (CTFE), fluorinated ethylene propylene, (FEP), polytetrafluoroethylene (PTFE), or polyvinylidine fluoride (PVDF) or combinations thereof. Tape 41 is approximately 0.0015 inch in thickness. After wrapping, the tape 41 provides a layer of about 0.006 inch thickness.

The dielectric layer also has a polymer extrusion 43, which is extruded over tape 41. Extrusion 43 is also a good high temperature electrical insulator and is preferably an FEP marketed under the name Teflon.

A protective metal sheath 45 is extruded over extrusion 43 in physical contact with outer dielectric layer 43. Protective sheath 45 is preferably of a material that is a good thermal conductor yet provides protection against damage to the electrical insulation layers 41 and 43. Preferably, sheath 45 is lead or a lead alloy, such as lead and copper. A rubber compound 46 surrounds sheath 45. An example of rubber compound 46 is epichlorohydrin rubber.

Outer armor 57 is wrapped around the rubber compound 46 subassembly. Armor 57 is a metal tape, preferably steel, that is wrapped as in conventional electric power cable for electrical submersible pumps. An additional layer of armor 58 (FIG. 2*a*) may be provided for extra strength. Armor 57 is a good heat conductor, which is facilitated by metal-to-metal contact with sheaths 45 through retainers (not shown).

Referring now to FIG. 3, shown is an electrical schematic diagram of an example of a two phase motor variable control and heater cable transformer control 311. The main power is supplied along lead 313 and lead 315. The power is preferably provided as an alternating current. The power passes through a switch gear 319.

Running from switch gear 319 is a lead 321 and a lead 323, which connect to a motor controller 327. A ground fault breaker 334 is located on leads 321 and 323. The power supplied to and from motor controller 327 is 460 volts. Leads 340 and 342 connect to a power transformer 346, which steps down the voltage from 460 to 240 volts. A ground fault breaker 347 is located on leads 340 and 342. A modulator controller 348 is connected via leads 340 and 342 to power transformer 346. Modulator controller 348 modulates signals for operating a thyristor 350. A switch gear 352 is positioned between modulator controller 348, motor controller 327 and thyristor 348. Fuses 353 are located on lines 321 and 323 between motor controller 327 and switch gear 352. Fuses 355 are located on lines 340 and 342 between modulator controller 348 and switch gear 352. Leads 354 and 356 run from switch gear 352 to thyristor 350. A temperature sensor 358 may be provided downhole to monitor cable temperature. Thyristor 350 decodes signals from modulator controller 348 to activate the thyristor 350 thereby creating a short between lines 354 and 356. The resulting short heats the lines 354 and 356 to de-ice an oilwell. Pump motor 362 is powered by lines 354 and 356 when thyristor 350 is open.

Referring now to FIG. 4, a schematic diagram of an alternate embodiment of the motor control and heater transformer control 411 is shown utilizing a three phase arrangement. Lead lines 413, 415 and 417 transfer power from the main power source 21 (FIG. 1). Lead lines 413, 415 and 417 are connected to a switch gear 419. Lead lines 421, 423 and 425 run from switch gear 419 to motor controller 427. Ground fault breaker 428 is located on lead lines 421, 423 and 425.

Lead lines 429, 431 and 433 run from switch gear 419 to switch gear 435. Ground fault breaker 436 is located on lead lines 429, 431 and 433. Lead lines 437, 439 and 441 run from switch gear 435 to power transformer 443. Power transformer 443 steps down the voltage from 460 to 240 volts. Lead lines 437, 439, and 441 run from power transformer 443 to phase modulator 445.

Lead lines 447, 449 and 451 run from switch gear 435 to power transformer 453. Ground fault breaker 452 is located on lead lines 447, 449 and 451. Power transformer 453 also steps down the voltage from 460 to 240 volts. Lines 447, 449, and 451 run from power transformer 453 to phase modulator 455. Lines 421, 423, 425, 437, 439, 441, 447, 449 and 451 connect to switch gear 457. Fuses 458, 460 and 462 are located on lines leading to switch gear 457.

Lines 459, 461 and 463 run from switch gear 457 to pump motor 465. A temperature sensor 467 may be installed downhole on lines 459, 461, or 463 to monitor cable temperature downhole. Thyristor 468 is installed downhole. Thyristor 468 decodes the signals from the modulator 445 and modulator 455. The thyristor 468 is preferably set up to turn on in a case of either high or low power. When the thyristor turns on, a short is created between leads 459 and 461 or 461 and 463, thereby causing the cable 21 (FIG. 1) to heat and de-ice the oilwell. Pump motor 465 draws power from leads 459, 461 and 463 when the thyristor 468 is open.

Referring now to FIG. 5, shown is a schematic diagram of an example electrical configuration showing a motor variable control and heater cable transformer control 511 in a three phase configuration. Lead lines 512, 514 and 516 transfer power from a main power source 21 (FIG. 1) to a switch gear 518. Lines 520, 522 and 524 transfer power from switch gear 518 to motor controller 526. Ground fault breaker 519 is located on lines 520, 522 and 524.

Lines 528, 530 and 532 transfer power from switch gear 518 to power transformer 534. Ground fault breaker 533 is located on lines 528, 530 and 532. A phase modulator 536 is connected to power transformer 534 by lines 528, 530 and 532, which continue to a second switch gear 537. Lines 520, 522, 524 connect motor controller 526 to second switch gear 537. Fuses 535 and 539 are located in lines leading to second switch gear 537.

Lines 538, 540 and 542 transfer power from second switch gear 537 to pump motor 544. A temperature sensor 545 may be provided downhole to sense the temperature of line 23 (FIG. 1) downhole. Thyristor 546 decodes signals from modulator 536 and selectively turns on to close a circuit between motor leads 538, 540 or 542, thereby creating a short. The electrical short causes the motor leads 538, 540, and/or 542 to heat up, which heats cable 23 (FIG. 1) and de-ices the oilwell. When the thyristor 546 is not closed, then power is transferred to pump motor 544 for normal operation.

In operation, when switch 39, such as thyristor 350, 468, or 546, is open, power is transferred down cable 23 to the ESP to power the motor 19. No heat is generated when switch 39 is in the open position, other than heat that is normally generated during pump operation. When it is determined by an operator that the well needs to be de-iced, an electrical signal is sent down the cable 23 to activate the switch 39 and to direct switch 39 to close.

When switch 39 is closed, three-phase power will be supplied to the three conductors 37. Although conductors 37 are low in resistance, heat is generated within conductors 37 because of high current flow. The heat passes through the thin dielectric layers 41 and 43, into the lead sheaths 45. The heat transmits readily through the lead sheaths 45 and out of armor 57 to tubing 29. The heat is transmitted to tubing 29 to maintain a desired minimum temperature in tubing 29.

A temperature sensing device, such as temperature sensor 358, 467, or 545, may be provided within or attached to the cable 23. Temperature sensing device 358, 467, or 545 can be used to monitor well conditions along the production tubing and/or to control the temperature of the cable 23 by automatically adjusting the current supplied to the cable 23 to achieve a preset desired temperature. An advantage of the temperature sensing device 358, 467, or 545 is that the temperature sensing device may be used to prevent the cable from exceeding design temperatures.

In operation, two or three phase power is supplied to cable 23. A two conductor system 311 is shown in FIG. 3. Two conductors are represented schematically in FIG. 3 as lines 313 and 315. In FIG. 4, a three conductor system 411 is shown. The three conductors are represented schematically as lines 413, 415 and 417. In FIG. 5, a three conductor system 511 is shown. The three conductors are represented schematically as lines 512, 514 and 516. When switch 26 (FIG. 1), e.g., thyristors 350 (FIG. 3), 468 (FIG. 4) and 546 (FIG. 5) are open, pump motor 19, e.g. pump motor 362 (FIG. 3), 465 (FIG. 4), or 544 (FIG. 5) operate normally.

In two phase system 311, such as is shown in FIG. 3, when it is desired to heat the pump cable to de-ice an oil well, modulator controller 348 sends a signal down leads 340 and 342 through switch gear 352 and on to leads 354 and 356 to thyristor 350. Thyristor 350 decodes the signal from modulator controller 348 and the thyristor 350 is turned on. An electrical short is created between leads 354 and 356, which heats motor leads 354 and 356, thereby de-icing the oilwell.

A three phase system may be used, such as system 411 or 511, which are represented in FIGS. 4 and 5, respectively. In FIG. 4, a three phase motor variable control and heater cable transformer control 411 is shown. The modulator controller 445 and/or 455 are operated to send a signal down to thyristor 468. Depending upon the voltage desired in leads 459, 461 and 463, modulators 445 and 455 may direct thyristor 468 to create a short between leads 459, 461, and/or between leads 461 and 463, which will generate heat among selected leads 459, 461, and 463 to de-ice an oil well.

Referring now to FIG. 5, a three phase motor variable control and heater cable transformer control modulator controller 511 is shown. Modulator 536 sends an electrical signal down to thyristor 546 through cables 538, 540, 542. Thyristor 546 decodes the signals from modulator controller 536 to selectively create a short between leads 538 and 540 or 540 and 542.

The temperature in the motor leads of the cable can be predicted by calculations taking into account the resistance of the cable and the amount of voltage applied thereto. However, if desired, temperature sensing devices, such as temperature sensor 358, 467, or 545, may be placed within or attached to the cable 23 (FIG. 1) to monitor well conditions along the production tubing 29 (FIG. 1) and/or to control the temperature of the cable 23 by automatically adjusting the current supplied to the cable to achieve a pre-set desired temperature.

While the invention has been shown in only one of its forms, it should be apparent to those skilled in the art that it is not so limited but is susceptible to various changes without departing from the scope of the invention. For example, rather than using three-phase power and three conductors for the heater cable, direct current power and two conductors could be employed. Additionally, although a three-conductor cable having touching lead sheaths are shown, conventional conductor cable with or without metal sheaths may be used. Also, in some cases the same drive or controller that controls the downhole motor may alternately be used to provide power to heat the cable/wellbore.

What is claimed is:

1. A submersible pump assembly comprising:

an electrical motor adapted to be placed in a well;

a centrifugal pump operatively connected to said electrical motor for pumping well fluid to a surface level;

a power cable having a plurality of conductors, said power cable being connected to said motor for transferring power from said surface level to said motor; and an electrical switch located at a selected point on a length of said cable, said electrical switch when closed connecting the conductors for introducing a short across said conductors of said power cable, which ceases delivery of power to said pump and generates heat to defrost portions of the well.

2. The submersible pump assembly according to claim 1 further comprising a temperature sensing device mounted along a length of said cable to monitor cable temperature.

3. The submersible pump assembly according to claim 1 further comprising a controller at surface level to move said electrical switch from an open position to a closed position.

4. The submersible pump assembly according to claim 1 further comprising:

a controller at surface level to move said electrical switch from an open position to a closed position; and sensor located downhole for sensing cable temperature.

5. The submersible pump assembly according to claim 1 further comprising:

a transformer at surface level that changes voltage to level suitable for operation of said electrical switch downhole.

6. A submersible pump assembly comprising:

an electrical motor adapted to be placed in a well;

a centrifugal pump operatively connected to said electrical motor for pumping well fluid to a surface level;

a power cable having a plurality of conductors, said power cable being connected to said motor for transferring power from said surface level to said motor;

an electrical switch located at a selected point on a length of said cable, said electrical switch when closed connecting the conductors for introducing a short across said conductors of said power cable, which ceases delivery of power to said pump and generates heat to defrost portions of the well;

a first transformer at surface level that changes voltage to a level suitable for operation of said electrical switch downhole and to heat said cable; and a second transformer at surface level that changes voltage to a level suitable for operation of said electrical switch downhole and to heat said cable, said first transformer and said second transformer used selectively to vary said voltage for operation of said electrical switch downhole and to heat said cable.

7. A well comprising:

an electrical submersible pump located in the well, wherein said electrical submersible pump has an electrical motor;

a power cable having a plurality of conductors operatively connected to said motor;

a power supply at the surface and connected to the power cable for transferring power from said surface level to said motor;

an electrical switch located at a selected point on said cable in the well, said electrical switch being connected between said conductors and having an open and a closed position; and a controller electrically connected with the switch for closing the switch, said closed switch for eliminating power supplied to said motor and introducing a short across said plurality of conductors of said power cable, so that a continued power supply generates heat in the cable above the switch to warm portions of the well.

8. The well according to claim 7 further comprising a temperature sensing device mounted along a length of said cable to monitor cable temperature, the controller being electrically connected to said sensor and opening and closing said switch in response to said sensor.

9. The well according to claim 7 further comprising a controller at surface level to move said electrical switch from an open position to a closed position.

10. The well according to claim 7 further comprising:

a transformer at surface level that changes voltage to level suitable for operation of said electrical switch downhole.

11. A well comprising:

an electrical submersible pump located in the well, wherein said electrical submersible pump has an electrical motor;

a power cable having a plurality of conductors operatively connected to said motor;

a power supply at the surface and connected to the power cable for transferring power from said surface level to said motor;

an electrical switch located at a selected point on said cable in the well, said electrical switch being connected between said conductors and having an open and a closed position;

a controller electrically connected with the switch for closing the switch, said closed switch for eliminating power supplied to said motor and introducing a short across said plurality of conductors of said power cable, so that a continued power supply generates heat in the cable above the switch to warm portions of the well;

a first transformer at surface level that changes voltage to a level suitable for operation of said electrical switch downhole and to heat said cable; and a second transformer at surface level that changes voltage to a level suitable for operation of said electrical switch downhole and to heat said cable, said first transformer and said second transformer used selectively to vary said voltage for operation of said electrical switch downhole and to heat said cable.

12. A power cable for supplying power to an electrical submersible pump comprising:

a power cable adapted to be placed in a well for use with an electrical submersible pump, said power cable having a plurality of conductors, said power cable being connected to a motor of said electrical submersible pump for transferring power from said surface level to said motor; and an electrical switch located at a selected point on a length of said cable, said electrical switch when closed connecting the conductors for introducing a short across said conductors of said power cable, which ceases delivery of power to said pump and generates heat to defrost portions of the well.

13. The power cable according to claim 12 further comprising an electrical sensor placed downhole for measuring temperature of said cable.

14. The power cable according to claim 12 further comprising a controller at surface level to move said electrical switch from an open position to a closed position.

15. The power cable according to claim 12 further comprising:

a transformer at surface level that changes voltage to level suitable for operation of said electrical switch downhole.

16. A method of heating a well comprising the steps of:

connecting an electrical submersible pump to a power cable having a plurality of conductors, providing the power cable with an electrical switch, which selectively interconnects the conductors at a selected point above the electrical submersible pump and lowering said electrical submersible pump into the well;

supplying power down the power cable to the ESP while said electrical switch is open to operate the ESP and pump fluid from said well; and closing the electrical switch and continuing to supply power down the power cable to cease operation of the ESP and cause heat to be generated from said power cable.

17. The method of heating a well according to claim 16 further comprising:

the step of monitoring the temperature in said well and opening and closing said electrical switch in response thereto.

* * * * *